United States Patent [19]

McClam

[11] 4,304,018

[45] Dec. 8, 1981

[54] BED COVERING

[76] Inventor: Paule McClam, 1401 Rue de Calais, Apt. 41, Bellevue, Nebr. 68005

[21] Appl. No.: 132,873

[22] Filed: Mar. 24, 1980

[51] Int. Cl.[3] ..... A47G 9/00

[52] U.S. Cl. ..... 5/494; 5/485; 5/499

[58] Field of Search ..... 5/485, 486, 493, 494, 5/497, 498, 499, 501

[56] References Cited

U.S. PATENT DOCUMENTS

| | | | |
|---|---|---|---|
| 3,965,504 | 6/1976 | Ainsworth | 5/485 |
| 3,999,233 | 12/1976 | Morris | 5/493 |
| 4,021,869 | 5/1977 | Root | 5/485 |
| 4,161,044 | 7/1979 | Bogle | 5/497 |

*Primary Examiner*—Roy D. Frazier

*Attorney, Agent, or Firm*—Zarley, McKee, Thomte, Voorhees & Sease

[57] ABSTRACT

A bed covering includes a top covering adapted to overlie the top surface of a mattress, a side covering adapted to be fitted to the mattress and to surround the head end, foot end and sides thereof, and a foldable side panel interconnecting the top covering and side covering along the foot end and at least one side of the mattress so that the mattress, side panel and top covering define somewhat of a sleeping bag type enclosure for receiving a person. A first zipper along the edge of the top covering and top edge of the side covering enable the bed to be made by simply closing the first zipper to thereby foldably collapse and enclose the side panel between the top covering and mattress. A second zipper may be provided between the side panel and side covering to facilitate entry onto the mattress below the bed covering.

10 Claims, 5 Drawing Figures

BED COVERING

BACKGROUND OF THE INVENTION

The present invention is directed to an improved bed covering which increases the warmth and comfort of persons sleeping on a bed and which greatly facilitates the making of the bed.

For many years, the practice and materials used in preparing a bed have remained substantially the same. Generally a mattress is provided with a fitted lower sheet, a tucked in upper sheet, a blanket and single piece bedspread which is draped over the bed and folded back at the front end to be doubled over the pillows to cover them as well.

Several problems are commonly experienced when sleeping in a bed having the conventional preparations. First, normal movements during sleeping often cause the bed covering to be loosened along the foot end or sides of the bed allowing drafts to enter below the bed coverings. If the conventional bed coverings do remain tucked in, they are necessarily rather binding. If two people are sleeping on the bed, it often happens that one ends up with the greater portion of the bed covering with the other simply clutching on to one side. Finally, the tedious task of making a bed having conventional bed coverings thereon is well known. These problems are resolved by the bed covering of the present invention.

A primary object of the invention therefore is to provide an improved bed covering.

Another object of the invention is to provide a bed covering which prevents drafts from entering between the mattress and bed covering along the foot end or sides of the mattress.

Another object is to provide an improved bed covering which provides warmth and yet is not binding.

Another object is to provide an improved bed covering which generally prevents one person on the bed from using a disproportionate share of the bed covering.

A further object is to provide an improved bed covering which substantially facilitates the making of the bed.

Finally, another object is to provide an improved bed covering which is economical to manufacture, refined in appearance and efficient in use.

SUMMARY OF THE INVENTION

The improved bed covering of the present invention includes a top covering adapted to overlie the top surface of a mattress, a side covering adapted to be fitted to the mattress and surround the head end, foot end and opposite sides thereof, and a foldable side panel interconnecting the top covering and side covering so as to define a somewhat sleeping bag enclosure for receiving a person. A first zipper connecting the top covering to the upper edge of the side covering enables the bed to be quickly and easily made by simply closing the first zipper and thereby collapsing and enclosing the side panel between the top covering and mattress. A second zipper connecting the lower edge of the side panel to the upper edge of the side covering provides for easier access on to the mattress below the bed covering and provides added freedom for persons who are more comfortable with looser bed coverings. A pillow covering is secured to the upper edge of the side covering across the head end of the mattress so that it may be simply flipped rearwardly over the pillows after the zippers have been closed to complete the making of the bed. A dust ruffle or the like may be depend from the lower edge of the side covering to conceal the box springs and provide an attractive finished appearance.

DESCRIPTION OF THE PREFERRED EMBODIMENT

Figure 1:
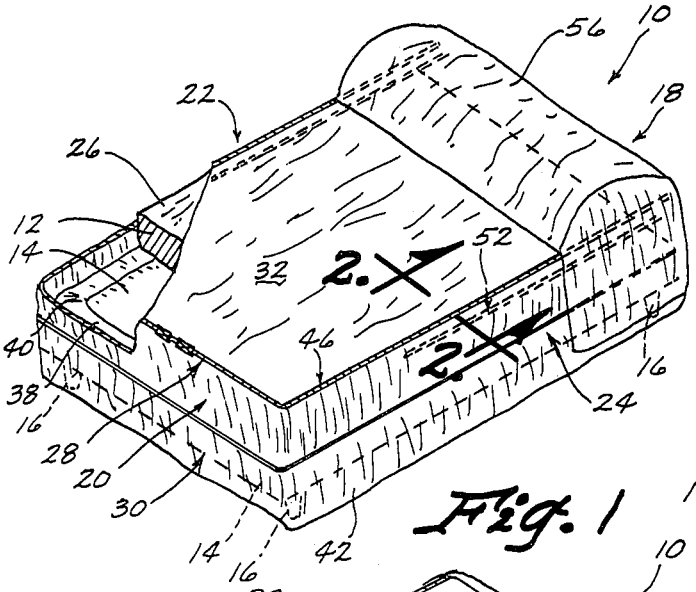
FIG. 1 is a perspective view of the bed covering fitted onto a mattress, and with a corner at the foot of the bed broken away to show the fitted portion of the bed covering.

The improved bed covering of the present invention, indicated generally at 10, is shown in FIG. 1 fitted on to a conventional bed including a mattress 12, box spring 14 and support frame 16. The mattress 12 shall be referred to as having a head end 18, foot end 20, opposite sides 22 and 24 and a top surface 26.

Bed covering 10 consists of an upper portion 28 which is adapted to be disposed above the upper surface 26 of the mattress, and a lower portion 30 which is adapted to be disposed generally below the upper surface 26 of the mattress. The upper portion 28 includes a generally flat top covering 32 which is adapted to overlie the upper surface 26 of the mattress and which is of a shape and size to substantially conform to the mattress surface 26. Upper portion 28 further includes a vertically expandable and collapsible peripheral side panel 34 which is connected to the top covering 32 along the foot end and both side edges thereof for a purpose described hereinbelow.

The lower portion 30 includes a peripheral side covering 36 which is adapted to cover the head end 18, foot end 20 and both sides 22 and 24 of the mattress 12. Side covering 36 is fitted on to the mattress 12 by a continuous peripheral interior extension 38 equipped with elastic gathered corner portions as shown best at 40 in FIG. 1. A skirt portion 42 is secured to the lower edge of the side covering 36 along at least the foot end and both sides thereof and depends from the side covering 36 to provide an attractive covering to conceal the box spring 14 and support frame 16.

Figure 2:
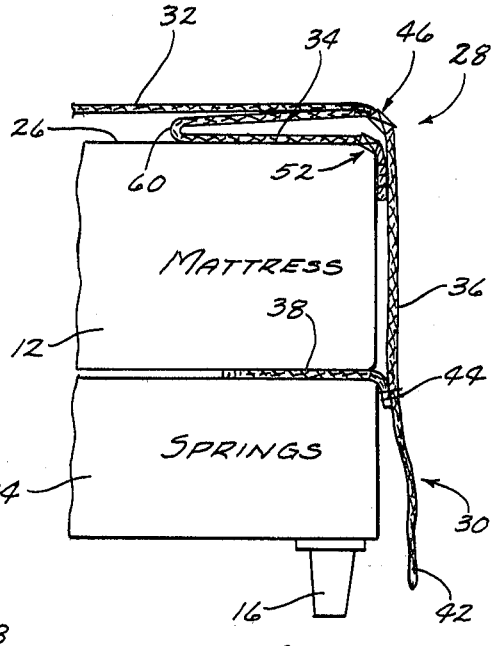
FIG. 2 is an enlarged longitudinal sectional view of one side of the bed covering as seen on line 2—2 in FIG. 1.
Figure 4:
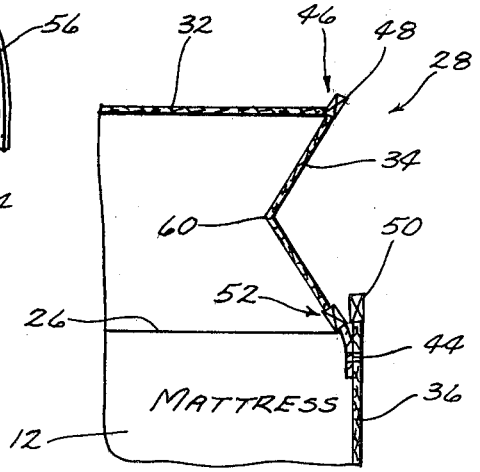
FIG. 4 is an enlarged longitudinal sectional view taken along line 4—4 in FIG. 3 and showing the bed covering with the outer zipper opened.
Figure 5:
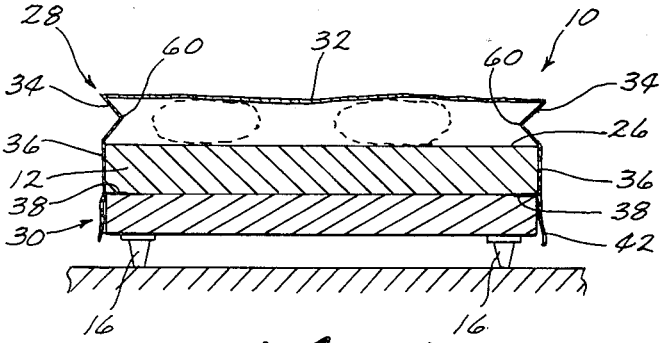
FIG. 5 is a transverse sectional view of the bed covering as seen on line 5—5 in FIG. 3.

In FIGS. 2 and 4, it can be seen that the lower edge of the foldable side panel 34 is stitched or otherwise secured to the side covering 36 adjacent the upper edge thereof as at 44. The mattress 12, side panel 34 and top covering 32 therefor defines somewhat of a sleeping bag type enclosure for receiving a person.

A first zipper 46 includes one side portion 48 secured along the foot end and opposite side edges of the top covering 32 and a coacting side portion secured along the top edge of the side covering 36 so that when the first zipper 46 is closed, the side panel 34 is foldably collapsed and enclosed between the mattress and top covering 32 as seen best in FIG. 2. First zipper 46 preferably includes a pair of zippers which meet at the center of the foot end of the bed and which are opened by zipping toward the center of the foot end of the bed enclosed by zipping toward the head end of the bed. Note that when the first zipper 46 is completely disengaged, the top covering 32 is free to move vertically relative to the mattress 12 so as not to be binding for a person sleeping on the mattress 12.

Figure 3:
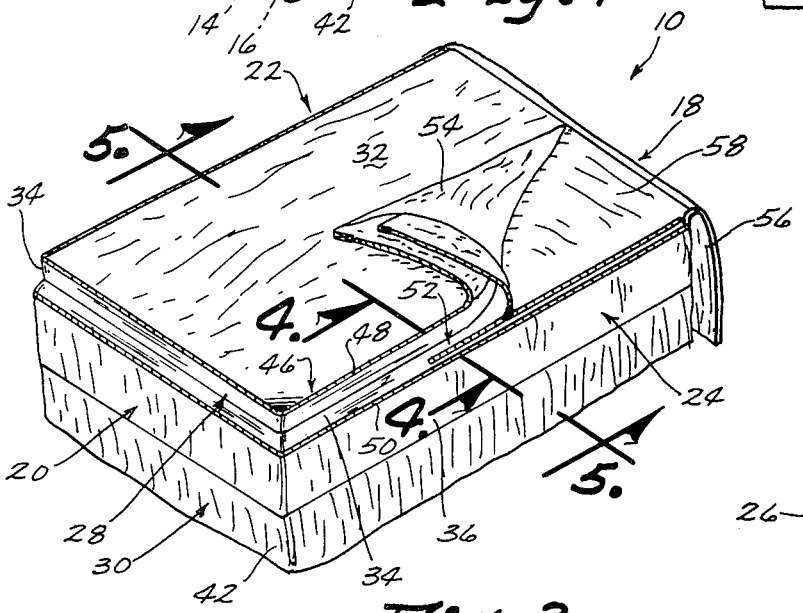
FIG. 3 is a perspective view of a bed showing the pillow covering flipped forwardly and both zippers opened for allowing a person to enter onto the bed below the bed covering.

A second zipper 52 is disposed along the lower edge of side panel 34 adjacent the head end of the mattress so that upon disengagement of the second zipper 52, a portion 54 of the top covering 32 and side panel 34 may be folded back as shown in FIG. 3 to permit entry on to the mattress below the bed covering. Preferably, a pair of second zippers 52 are provided, with one on each of opposite sides of the bed covering.

The bed covering is completed by a pillow covering portion 56 which is extended transversely of the bed covering and secured to the upper edge of the peripheral side covering 36 across the head end thereof. When the bed is in use, the pillow covering portion 56 can simply hang downwardly at the end of the bed whereas, when the bed is to be made, the pillow covering portion 56 is adapted to be flipped rearwardly over the pillows situated on the top covering adjacent the head end of the mattress as shown in FIG. 1.

It is apparent that the bed covering 10 is open bottom and that therefore it is intended that a person sleeping on the bed rests directly on a conventional fitted sheet 58 (FIG. 3). Bed covering is then easily placed over the bed in much the same manner as the fitted sheet 58. With both zippers 46 and 52 closed, it is only necessary to place the pillows adjacent the head end of the bed and to flip the pillow covering portion 56 back over the pillows to complete the making of the bed.

To sleep on the bed, one need only lift the pillow covering portion 56 forwardly and unzip the first zipper 46 to allow some vertical freedom for the top covering 32 relative to the mattress 12. Entry can be furthermore facilitated by at least partially disengaging the second zipper 52 as shown in FIG. 3 so that entry can be made from the side of the bed. Once a person is lying on the bed, the second zipper 52 may be zipped closed if desired. Since the fitted extension 38 on side covering 36 extends around the entire periphery of the bed, no drafts can be directed on to persons covered by the bed covering 10. Accordingly, persons on the bed are kept comfortably warm without the binding effect of conventional bed coverings. The fitted side covering 36 furthermore prevents one person from using a disproportionate share of the bed covering as often occurs with conventional sheets and blankets.

Making a bed covered by the bed covering 10 is a very simple operation. By closing second zipper 52 and then the first zipper 46, the side panel 34 is automatically folded along the center line 60 thereof so as to lie in two-ply thickness between the mattress and top covering as shown in FIG. 2. Closing of the first zipper 46 furthermore stretches the top covering 32 across the top surface 26 of the mattress so as to remove all wrinkles therefrom. The pillows are then placed on the top covering 32 adjacent the head end of the bed and the pillow covering portion 56 is flipped rearwardly to complete the making of the bed.

Whereas a preferred form of the invention has been shown and described herein, it will be readily apparent to those skilled in the art that many substitutions, modifications and variations may be made thereto without departing from the intended broad scope of the invention as defined in the appended claims. For example, it may be desirable for certain embodiments to have the side panel 34 and first zipper 46 extend only along one side of the bed or along the foot end 20 and one side. Likewise, many other types of fastening means may be substituted for the zippers although the zipper has been found to be most convenient because it is so easily disengaged and may be easily concealed by decorative edging on the material to which it is sewn. Thus there has been shown and described an improved bed covering which accomplishes at least all of its stated objects.

I claim:

1. A bed covering for a mattress having a head end, a foot end, opposite sides and a top surface, said bed covering comprising, a fitted side covering adapted to overlie the head end, foot end and sides of a mattress and means for fitting said side covering onto a mattress, a top covering adapted to overlie the top surface of the mattress, and a foldable and vertically extendable and collapsible side panel interconnecting said side covering and top covering along the foot end and both sides of the mattress, said foldable side panel being vertically extendable independently of said side covering whereby said mattress, side panel and top covering define an enclosure for receiving a person, and a first zipper means along the edge of said top covering and top edge of the said side covering whereby a bed may be made by closing the first zipper means to thereby foldably collapse and enclose said side panel between said top covering and mattress.

2. The bed covering of claim 1 further comprising a second zipper means along the lower edge of said side panel and upper edge of said side covering adjacent the head end of the mattress whereby, upon disengagement of said second zipper means, a portion of said top covering and side panel may be folded back to permit entry onto the mattress below said bed covering.

3. The bed covering of claim 2 wherein said first and second zipper means each include a pair of zippers adapted to be positioned along opposite sides of the mattress.

4. A bed covering for a mattress having a head end, a foot end, opposite sides and an upper surface, said bed covering comprising, an upper portion adapted to be disposed generally above the upper surface of the mattress, said upper portion including a generally flat top covering adapted to overlie said upper surface of the mattress, and a vertically expandable and collapsible peripheral side panel along the foot and at least one side of the mattress, a lower portion adapted to be disposed generally below the upper surface of said mattress, including a peripheral side covering adapted to cover the head, foot and both sides of the mattress, and means for fitting said peripheral side portion onto said mattress, and a first coacting fastening means on said top covering and side covering for enclosing said side panel in a collapsed position interiorly thereof, and a second coacting fastening means along the lower edge of said side panel and upper edge of said side covering adjacent the head end of the bed whereby upon disengagement of said second coacting fastening means, said upper portion may be folded back to permit entry onto the mattress below said bed covering.

5. The bed covering of claim 4 wherein said expandable and collapsible peripheral side panel extends along the foot end and both sides of said top covering and is secured thereto.

6. The bed covering of claim 4 further comprising a skirt portion secured to said peripheral side covering along at least the foot end and both sides thereof, said skirt portion depending from said side covering to conceal those portions of a bed below said mattress.

7. The bed covering of claim 4 wherein said expandable and collapsible peripheral side panel is adapted to be folded along the center line thereof so as to lie in two-ply thickness between said mattress and top covering when said first coacting fastening means is closed.

8. The bed covering of claim 4 further comprising a pillow covering portion secured to the upper edge of said peripheral side covering across the head end thereof and adapted to be placed over a pillow situated on said top covering adjacent the head end of the mattress.

9. The bed covering of claim 4 wherein said first and second elongated coacting fastening means comprise first and second zippers.

10. A bed covering for a mattress having a head end, a foot end, opposite sides and a top surface, said bed covering comprising, a fitted side covering adapted to overlie the head end, foot end and sides of a mattress and means for fitting said side covering onto a mattress, a top covering adapted to overlie the top surface of the mattress, and a foldable and vertically extendable and collapsible side panel interconnecting said side covering and top covering along the foot end and both sides of the mattress, said foldable side panel being vertically extendable independently of said side covering whereby said mattress, side panel and top covering define an enclosure for receiving a person, and a first fastener means along the edge of said top covering and top edge of the said side covering whereby a bed may be made by closing the first fastener means to thereby foldably collapse and enclose said side panel between said top covering and mattress.

* * * * *